US005782148A

United States Patent [19]

Kerkhoven

[11] Patent Number: 5,782,148

[45] Date of Patent: Jul. 21, 1998

[54] DUAL DEPTH SOCKET

[76] Inventor: Edward Kerkhoven, 4414 Ridge Road, Fournier, Ontario, Canada, K0B 1G0

[21] Appl. No.: 682,427

[22] Filed: Jul. 17, 1996

[51] Int. Cl.[6] ..... B25B 13/00; B25B 13/58

[52] U.S. Cl. ..... 81/124.6; 81/121.1; 81/124.4; 81/186

[58] Field of Search ..... 81/124.6, 121.1, 81/125, 186, 124.3, DIG. 11, 124.7

[56] References Cited

U.S. PATENT DOCUMENTS

| | | | |
|---|---|---|---|
| 445,451 | 1/1891 | Miller | 81/124.4 |
| 838,109 | 11/1906 | Hanes et al. | 81/124.4 |
| 2,848,916 | 9/1958 | Reynolds . | |
| 2,956,462 | 10/1960 | Paul | 81/125 |
| 3,273,430 | 9/1966 | Knudsen et al. | 81/124.6 |
| 3,433,018 | 3/1969 | Ondeck | 81/12.6 |
| 3,620,106 | 11/1971 | Dixon . | |
| 3,668,951 | 6/1972 | Talmage | 81/124.6 |
| 4,598,616 | 7/1986 | Colvin | 81/124.6 |
| 5,544,555 | 8/1996 | Corley et al. | 81/125 |
| 5,615,587 | 4/1997 | Foerster, Jr. | 81/125 |

*Primary Examiner*—James G. Smith
*Assistant Examiner*—Lee Wilson

[57] ABSTRACT

A wrench socket has a fastener receiving recess extending inwardly from an end face of the socket. A first set of equally spaced-apart long points and a second set of equally spaced-apart short points are formed on the inner surface of the recess, each short point located between two long points. The points are parallel to the longitudinal axis of the recess. The long points extend inwardly from the end face for a length that is substantially greater than the height of the fastener element that fits within the recess while the short points extend inwardly from the end face for a length that allows axial pressure to be applied to the fastener element by the inner ends of the short points. Preferably the second set of points extend inwardly from the end face for a length that is slightly less than the height of the fastener element.

20 Claims, 3 Drawing Sheets

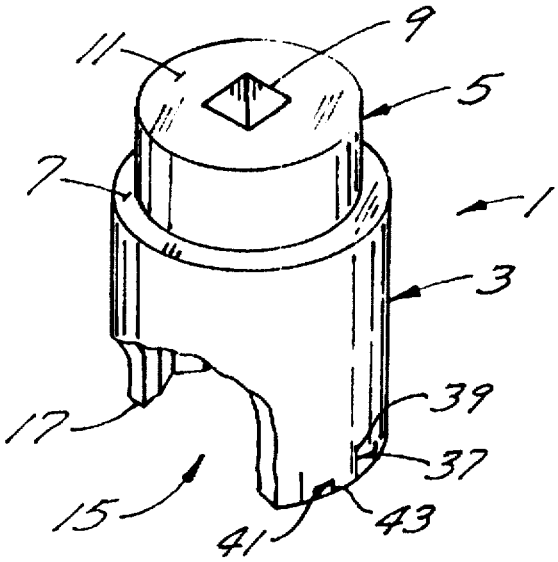
FIG. 1
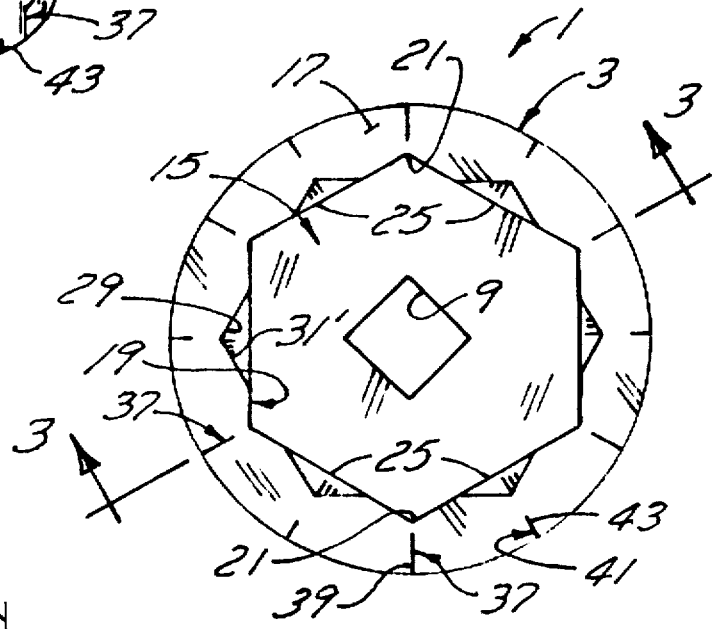
FIG. 2
FIG. 3
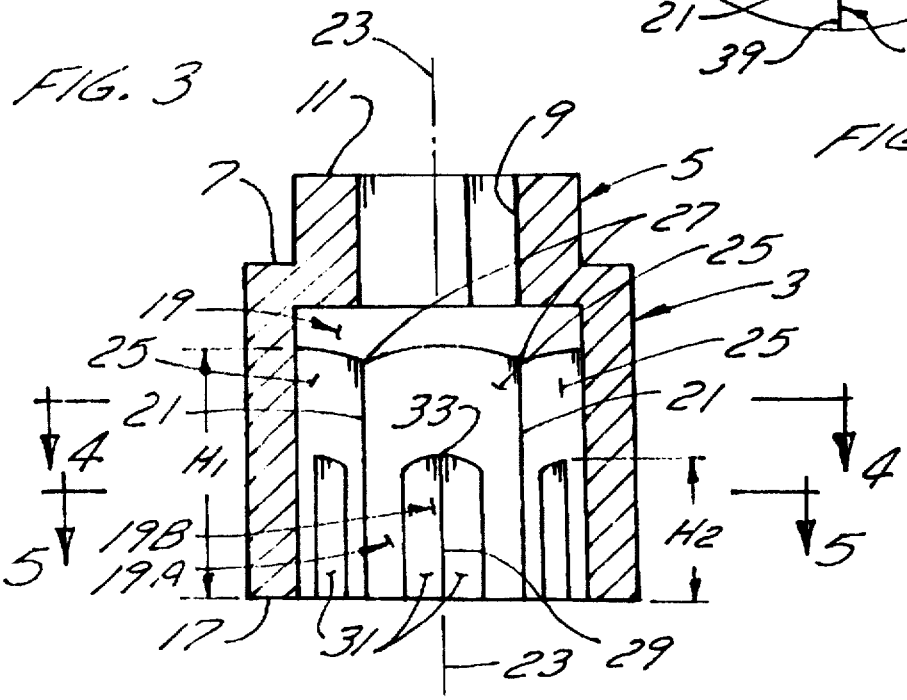

DUAL DEPTH SOCKET

BACKGROUND OF THE INVENTION

1. Field of the Invention

This invention is directed toward a new wrench socket.

2. Description of the Related Art Including Information Disclosed Under CFR §§ 1.97–1.99

Wrench sockets have a recess for receiving a fastener element such as the head of a bolt, or a nut, that is to be tightened. The recess is shaped to snugly fit over the head of a bolt, or a nut, of a specific size and usually has inner corners, or points, equal in number to the outer corners on the head or nut. For example, if the bolt head or nut is hexagon shaped, having six outer corners, the recess to fit this head or nut would be hexagon shaped as well having six inner corners or points. Often, the recess will have inner corners, or points, double in number to the outer corners on the head or nut. Thus for a hexagon shaped bolt head or nut, the recess could be formed by double hexagons providing twelve inner corners or points. The double number of points makes it quicker and easier to fit the socket on the fastener element.

The sockets are normally made with the recess much deeper, and the points, whether six or twelve, substantially longer, than the height of the bolt head or nut it is to be used with. This is done to ensure that there is contact between the socket and the fastener element over the full height of the fastener element. This construction however leads to certain disadvantages. The main disadvantage is that the user is usually unable to apply axial pressure onto the head or nut, via the socket, which axial pressure would be useful in starting the fastener element. The user is unable to apply axial pressure on the fastener element because the socket recess is normally quite deep and the points, whether six or twelve, are normally quite long. Because the points are quite long, many fasteners are not long enough to have their head, or the nut associated with them, rest on the inner ends of the points which inner ends could provide axial pressure when starting the fastener element with the socket.

Another disadvantage of sockets with deep recesses and long points is that the end face of the socket can contact the surface of the part that the bolt or nut is being fastened to and can scratch or mar the surface when it is being rotated. A further disadvantage is that the fastener element usually disappears within the socket and the user is unable to see when the fastener element is nearly tight. Other disadvantages are that the user is unable to see if a nut is properly threading onto the bolt. Often the nut is cross-threaded onto the bolt ruining the threads before the user is aware of what is happening because he is unable to see the nut start onto the bolt. Where an electrical connection is made to a bolt with a wire, the end face of the socket can contact the wire damaging it during application of a nut onto the bolt, or it can even push the wire out from under the nut. Also, sockets with deep recesses and twelve long points are relatively weak because their wall thickness is less compared to sockets with deep recesses and only six long points.

SUMMARY OF THE INVENTION

It is the purpose of this invention to provide a new wrench socket that overcomes the above main problem of often being unable to apply axial pressure with the socket on a fastener element when starting the element. In accordance with the present invention a wrench socket is provided having a fastener recess which has both a set of long points and a set of short points on its inner surface. The set of long points extend for a depth from the end face of the socket that is substantially greater than the height of the fastener element for which the socket is sized. The set of short points which are parallel to, but laterally offset from, the set of long points, extend for a depth from the end face that allows axial pressure to be applied to the fastener element by the inner ends of the short points.

The socket can be used with either the short or long points on the fastener element. When the long points are used, the socket acts as a normal socket. When the short points are used on the fastener element, the socket still acts as a normal socket but now axial pressure can also be applied to the fastener element when starting it.

It is a further purpose of the present invention to provide a modified new wrench socket with both long and short points that not only allows axial pressure to be applied to the fastener element when required by the inner ends of the short points but also allows the user to see the fastener element when using the socket. This is done by having the short points made short enough so that the fastening element projects slightly from the socket when mounted fully on the inner ends of the short points. This allows the user to see when the fastener is nearly tight and to see if a nut is properly threading onto a bolt. Being able to see the fastener element also allows the user to avoid damaging any wires connected to the fastener. Further, the projecting fastener element prevents the end face of the socket from marring the surface of the part that the fastener is being fastened to. Using the short set of points on the socket also allows the user to easily remove a loose nut from the socket since it can be grasped while projecting from the socket. This new, modified socket can be used with either the short or long points on a fastener element.

The invention is particularly directed toward a wrench socket having a fastener element receiving recess extending inwardly from an end face of the socket, the recess having a first set of equally spaced-apart long points on its inner surface. The first set of long points are parallel to the longitudinal axis of the recess and extend inwardly from the end face for a length that is substantially greater than the height of the fastener element that fits within the recess. A second set of equally spaced-apart short points, equal in number to the long points, are provided on the inner surface of the recess, parallel to the long points but laterally spaced therefrom. The second set of short points extend inwardly from the end face for a length that allows axial pressure to be applied to the fastener element by the inner ends of the short points. Preferably, the second set of points extend inwardly from the end face for a length that is less than the height of the fastener element that fits within the recess.

BRIEF DESCRIPTION OF THE DRAWINGS

FIG. 1 is a perspective view of the wrench socket, partially cut away;

FIG. 2 is an end view of the wrench socket;

FIG. 3 is a cross-section view taken along line 3—3 of FIG. 2;

DESCRIPTION OF THE PREFERRED EMBODIMENTS

Figure 4:
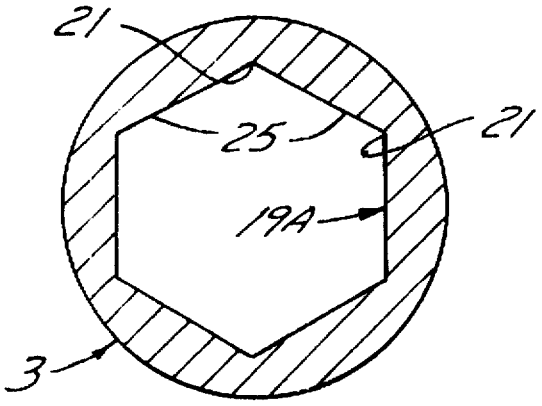
FIG. 4 is a cross-section view taken along line 4—4 in FIG. 3.

The wrench socket 1 of the present invention, as shown in FIG. 1, has a cylindrical body 3. The body 3 can have a slightly smaller cylindrical base 5 projecting axially from one end face 7 thereof. A drive opening 9 extends axially inwardly from the free end 11 of the base 5. The drive opening 9 is preferably square and receives the drive shaft of a socket wrench handle (not shown) that is used to rotate the socket when in use.

The body 3 of the socket 1 has a fastener element receiving recess 15 extending axially inwardly from its other end face 17. The recess 15 is sized to receive a standard size fastener element. The fastener element may be a nut that is to be fastened on a bolt with the aid of the socket or it can be a bolt head of a bolt which is received in the recess 15.

The side wall 19 defining the recess 15 is shaped to define a first set of equally spaced-apart, long points 21 as shown in FIGS. 2 to 4. The points 21 extend inwardly from the end face 17, parallel to the longitudinal axis 23 of the socket. Each point 21 is the inner corner between two adjacent first, flat surfaces 25. The first, flat surfaces 25 help define the side wall 19 of the recess 15. The set of long points 21 extend inwardly from the end face 17 a length H1 that is substantially greater than the height of the conventional nut or the head of the conventional bolt received in the recess 15. The inner ends 27 of the long points 21 form first stops to limit inward movement of the fastener element as will be described.

The side wall 19 is further shaped to define a second set of equally spaced-apart, short points 29. The short points 29 are equal in number to the number of long points 21 and also extend inwardly from the end face 17, parallel to the longitudinal axis 23. The short points 29 are spaced laterally from the long points 21. Preferably each short point 29 is equidistant from two adjacent long points 21. The short points 29 are also inner corners between two adjacent, second, flat surfaces 31. The second flat surfaces 31 also help to define the side wall 19 of the recess 15.

The second set of short points 29 extend inwardly from the end face 17 a length H2 that allows axial pressure to be applied to the fastener element by the inner ends 33 of the short points 29. This length H2 is at least equal to the height of the nut or bolt head received in the recess but is usually greater. The length H2 is also substantially shorter than the length H1 of the long points. The inner ends 33 of the short points 29 form second stops to limit the inward movement of the fastener element within the recess.

Figure 5:
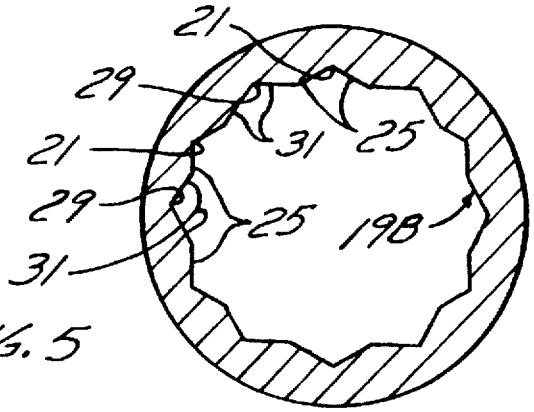
FIG. 5 is a cross-section view taken along line 5—5 in FIG. 3.

The first, flat surfaces 25 are continuous, joined to each other to define the portion 19A of the side wall 19 of the recess 15 that is between the inner ends 33 of the second set of short points 29 and the inner ends 27 of the first set of long points 21 as shown in FIGS. 3 and 4. The first, flat surfaces 25 are discontinuous, interrupted by the second, flat surfaces 31 in the portion 19B of the side wall 19 containing the second set of short points 29 as shown in FIGS. 3 and 5. The second flat surfaces 31 are also discontinuous, interrupted by the first flat surfaces 25. Both sets of flat surfaces 25, 31 together define the side wall portion 19B of the recess 15 in the area of the second set of points 29.

There are preferably six long points 21 and six short points 29 in each set to accommodate hexagon-shaped fastener elements. However each set of points could number four or five. Irregardless of the number of points in each set, both sets always have the same number of points.

If desired, one, or more, first marks or indicators 37 could be provided on the socket to indicate the location of the first set of points 21 as shown in FIG. 2. The marks 37 could be in the form of one or more radial lines 39 on the end face 17 of the socket aligned with one or more of the points 21. The lines 39 could continue up the cylindrical surface of the body 3 from the end face 17 and parallel with the axis 23 as shown in FIG. 1. A second set of marks or indicators 41 could be provided on the socket, also preferably on its end face 17, to indicate the location of the second set of points 29. The marks 41 could also be in the form of one or more lines 43 aligned with one or more of the points 29. These lines 41 could also continue up the cylindrical surface of the body 3. The lines 39, indicating the location of the long points 21, would be longer than the lines 43 indicating the location of the short points 29 as shown in FIGS. 1 and 2. Marks or indicators other than lines could be used to indicate the location of one or both sets of points.

Figure 6:
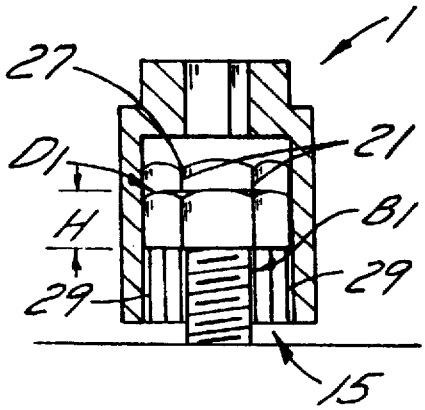
FIG. 6 is a cross-section view showing the socket being used with the set of long points.
Figure 7:
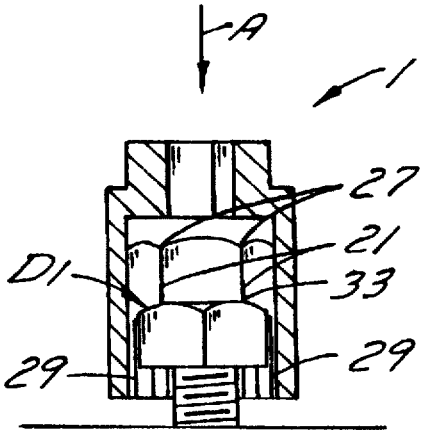
FIG. 7 is a cross-section view showing the socket being used with the set of short points.

In use, the socket 1 can be used in one manner with the long points 21 receiving the fastener element, which is shown as the head D1 of a bolt B1 in FIG. 6 within its recess 15. In this use, the corners of the bolt head D1 are aligned with the long points 21 and the bolt head D1 is completely within the socket recess 15 since the long points 21 have a length H1 that is substantially greater than the height H of the bolt head D1. In some instances, the fastener B1 is long enough that the bolt head D1 abuts the inner ends 27 of the long points 21 allowing axial pressure to be applied on the fastener element when starting it. Normally however, the fastener B1 is not long enough to reach the inner ends 27 of the long points 21 and if axial pressure is needed, such as when the fastener is a lag bolt, the socket is used in a second manner with the short points 29 receiving the fastener element. In this second manner of use, the head D1 of the fastener B1, still completely within the recess 15, abuts the inner ends 33 of the short points 29, as shown in FIG. 7, allowing axial pressure to be applied to the fastener.

Figure 8:
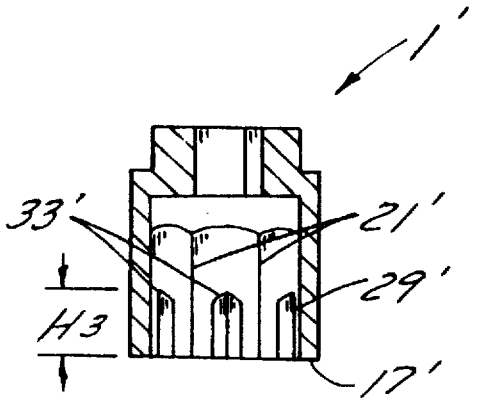
FIG. 8 is a cross section view of a modified socket.
Figure 9:
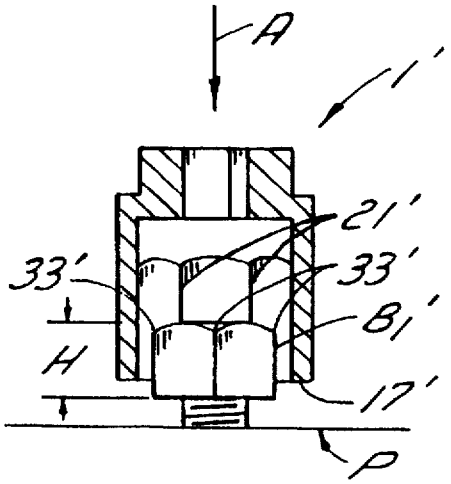
FIG. 9 is a cross section view of the modified socket being used with the set of short points.

A modified socket 1', shown in FIG. 8, has a second set of short points 29' that have a length H3 that is slightly less than the height H of the fastener element. This socket 1' can also be used in one manner with the long points 21' receiving the fastener element which is shown as the head D1' of a bolt B' within its recess (not shown). In this use, the bolt head is completely within the recess and normally, axial pressure cannot be applied to the fastener element by the socket. When the socket is used in a second manner, as shown in FIG. 9, the fastener element is mounted in the second set of short points 29' with the fastener element abutting their inner ends 33'. In this second manner of use, the bolt head B1' projects slightly past the end face 17' of the socket since the length H3 of the short points 29' is slightly less than the height H' of the bolt head. When used in this manner, the end face 17' of the socket 1' will not contact the surface S of the part P being joined with the fastener as shown in FIG. 9. Axial pressure can still be brought to bear on the bolt by the user's hand, via the socket 1, and more particularly, the stop ends 33' of the short points 29', as shown by the arrow A in FIG. 9. If a nut is being used instead of a bolt, and it is mounted in the short points 29', it is easily slipped out of the socket, if needed, since it already partly projects therefrom and can be grasped. Since the nut is visible in this use the user can tell if the nut is properly started onto the bolt to which it is to be attached by the socket. The user can also tell when the nut, or bolt, is almost tightened.

The sockets 1 and 1' are easily manufactured by using two broaching operations, one to cut the first set of long points 21 or 21' and the other to cut the second set of short points 29 or 29'.

Figure 10:
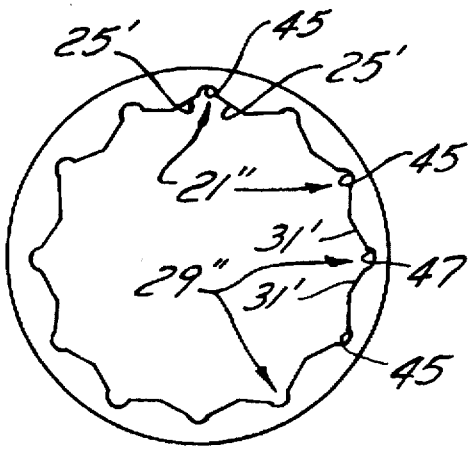
FIG. 10 is a detail view of another modified socket incorporating the invention.

The sockets 1 and 1', shown in FIGS. 1 to 9, have the long and short points 21, 21, and 29, 29' defined by the sharp, inner corners formed where the flat surfaces 25, 31 abut. The points 21", 29" could also be defined by scalloped corners 45, formed where the flat surfaces 25', 31' respectively would abut as shown in FIG. 10.

I claim:

1. A wrench socket having a fastener element receiving recess of uniform size extending inwardly from one end face of the socket, the fastener element receiving recess having a first set of equally spaced-apart long points on its inner surface, the set of long points parallel to the longitudinal axis of the recess and extending inwardly from the one end face for a length that is substantially greater than the height of the fastener element that fits within the recess; a second set of equally spaced-apart short points, equal in number to the first set of long points, on the inner surface of the recess, parallel to the set of long points but laterally spaced therefrom, the second set of short points extending inwardly from the end face for a length that allows axial pressure to be applied to the fastener element by the inner ends of the short points; the number of short and long points each equal in number to the number of corners on the fastener element that fits within the recess so that the same fastener element can be selectively held by the long or short points within the recess.

2. A wrench socket as claimed in claim 1 wherein the short points extend inwardly from the end face for a length that is slightly less than the height of the fastener element.

3. A wrench socket as claimed in claim 2 wherein each point of the short points is equidistant from two adjacent long points.

4. A wrench socket as claimed in claim 2 wherein the number of points in each set is six.

5. A wrench socket as claimed in claim 2 wherein each point of the short points is equidistant from two adjacent long points and the number of points in each set is six.

6. A wrench socket as claimed in claim 2 including a first indicating means on the outer surface of the socket to indicate the location of one of the sets of points.

7. A wrench socket as claimed in claim 2 including a first indicating means on the outer surface of the socket to indicate the location of the first set of points and a second indicating means on the outer surface of the socket to indicate the location of the second set of points.

8. A wrench socket as claimed in claim 2 wherein each point of the short points is equidistant from two adjacent long points and the socket includes a first indicating means on the outer surface of the socket to indicate the location of one of the sets of points.

9. A wrench socket as claimed in claim 2 wherein each point of the short points is equidistant from two adjacent long points and the socket includes a first indicating means on the outer surface of the socket to indicate the location of the first set of points and a second indicating means on the outer surface of the socket to indicate the location of the second set of points.

10. A wrench socket as claimed in claim 2 wherein the points are defined by sharp inner corners formed where flat adjacent surfaces, defining a portion of the recess, meet.

11. A wrench socket as claimed in claim 1 wherein each point of the short points is equidistant from two adjacent long points.

12. A wrench socket as claimed in claim 1 wherein the number of points in each set is six.

13. A wrench socket as claimed in claim 1 wherein each point of the short points is equidistant from two adjacent long points and the number of points in each set is six.

14. A wrench socket as claimed in claim 1 including a first indicating means on the outer surface of the socket to indicate the location of one of the sets of points.

15. A wrench socket as claimed in claim 1 including a first indicating means on the outer surface of the socket to indicate the location of the first set of points and a second indicating means on the outer surface of the socket to indicate the location of the second set of points.

16. A wrench socket as claimed in claim 1 wherein each point of the short points is equidistant from two adjacent long points and the socket includes a first indicating means on the outer surface of the socket to indicate the location of one of the sets of points.

17. A wrench socket as claimed in claim 1 wherein each point of the short points is equidistant from two adjacent long points and the socket includes a first indicating means on the outer surface of the socket to indicate the location of the first set of points and a second indicating means on the outer surface of the socket to indicate the location of the second set of points.

18. A wrench socket as claimed in claim 1 wherein the points are defined by sharp inner corners formed where flat adjacent surfaces, defining a portion of the recess, meet.

19. A wrench socket as claimed in claim 1 wherein the points are defined by scallops formed at the corners where flat adjacent surfaces, defining a portion of the recess, meet.

20. A wrench socket as claimed in claim 1 having a wrench receiving recess extending inwardly from the other end face of the socket, the wrench receiving recess being smaller than the fastener receiving recess.

* * * * *